US007336195B2

(12) United States Patent
van de Ven

(10) Patent No.: US 7,336,195 B2
(45) Date of Patent: Feb. 26, 2008

(54) LIGHT EMITTING ARRAY APPARATUS AND METHOD OF MANUFACTURE

(75) Inventor: Antony van de Ven, Hong Kong (HK)

(73) Assignee: Lighthouse Technologies Ltd., Hong Kong SAR (CN)

( * ) Notice: Subject to any disclaimer, the term of this patent is extended or adjusted under 35 U.S.C. 154(b) by 87 days.

(21) Appl. No.: 11/100,619

(22) Filed: Apr. 7, 2005

(65) Prior Publication Data

US 2006/0227003 A1 Oct. 12, 2006

(51) Int. Cl.
*G08B 5/22* (2006.01)

(52) U.S. Cl. ..... 340/815.45; 257/712; 315/291; 340/815.49; 340/815.53; 362/470

(58) Field of Classification Search ..... 340/815.45, 340/815.53, 815.49; 315/291; 257/232, 257/712; 362/231, 232, 236, 240, 242, 238, 362/249, 373, 800, 812, 470
See application file for complete search history.

(56) References Cited

U.S. PATENT DOCUMENTS 5,632,551 A * 5/1997 Roney et al. ..... 362/485
6,527,422 B1 * 3/2003 Hutchison ..... 362/373
2002/0125839 A1 * 9/2002 Yen ..... 315/291
2003/0048641 A1 * 3/2003 Alexanderson et al. ..... 362/470
2003/0063463 A1 * 4/2003 Sloan et al. ..... 362/238
2003/0137428 A1 * 7/2003 Hutchison ..... 340/815.45
2003/0189829 A1 * 10/2003 Shimizu et al. ..... 362/240
2004/0026721 A1 * 2/2004 Dry ..... 257/232
2004/0165381 A1 * 8/2004 Waters ..... 362/242
2004/0222516 A1 * 11/2004 Lin et al. ..... 257/712
2005/0062396 A1 * 3/2005 Yang ..... 313/470

* cited by examiner

*Primary Examiner*—Brent A. Swarthout
(74) *Attorney, Agent, or Firm*—Jacobson Holman PLLC

(57) ABSTRACT

This invention provides a light emitting array apparatus for use in a video screen display or lighting device incorporating a panel having a plurality of LEDs. Such a panel provides a plurality of LEDs on the front face of the panel in close thermal proximity to the panel. Typically this would include LEDs mounted to a PCB that is then affixed to the panel such that heat may transfer from the LEDs into the support panel itself. The support panel can disperse the heat throughout the panel and the to the surrounding air, especially from the front face of the panel. Such a construction may alleviate the need for fans or other cooling apparatus behind the panel and allow for the panel to be fitted directly to a supporting wall or other structure and also reduce cost and bulk of construction.

13 Claims, 5 Drawing Sheets

LIGHT EMITTING ARRAY APPARATUS AND METHOD OF MANUFACTURE

FIELD OF THE INVENTION

This invention relates to light emitting array apparatus having a plurality of light emitting diodes (LEDs) such as those for the display of video content as a video screen or billboard for advertising. Other such devices may include panels of LEDs for general illumination, traffic signals, etc.

BACKGROUND TO THE INVENTION

A large number of video screens or other display devices utilizing LEDs already exist in the marketplace. The normal method for constructing such display screens is to provide a plurality of LEDs mounted through a printed circuit board (PCB). Driving circuitry for the LEDs may be mounted on further boards or on the reverse side of the PCB to which the LEDs are mounted.

The PCB and LED combination are then typically mounted into a box such that the LEDs may protrude through holes in a front screen to display to the front of the display or be enclosed behind a transparent cover or lens.

It is a common problem in the industry that the use of a plurality of LEDs to provide a display generate significant heat from the LEDs themselves. As the LEDs are typically contained within a housing, the heat is usually drawn from the LEDs, through the PCB and distributed to the air behind the PCB. Of course, while the entire apparatus is contained in a larger housing, significant efforts in the form of fans, cooling systems, heat sinks or similar need to be employed behind the PCB to draw the heat from the rear of the PCB and exhaust this heat out of the back or sides of the screen.

Such a system requires either access to the external environment from the rear of the screen such as air circulating behind the screen housing or more complicated methods to remove the heat. Furthermore, display screens in this form are relatively bulky due to the accommodation of fans and cooling systems. They are also expensive due to the extra elements required and heavier when it comes to transportation or installation of the screens.

A further problem with such screens is that any maintenance or similar problems with the screen need to be dealt with through access panels in the back of the housing requiring access to the back of the panel.

The result of such problems is that display screens are typically constructed as standalone items so that access to both air and maintenance personnel can be maintained to the back of the screen. They cannot easily be mounted to an existing wall or other support structure without an air gap behind the housing or complex fitting arrangements to allow the screen to be rotated away from the wall or support structure for access to be gained for servicing.

Similar problems with heat may also exist with LED devices used for general lighting, automotive lights, traffic signal lights and other such devices. Again, a plurality of LEDs in a panel may generate significant heat leading to often-bulky constructions.

OBJECT OF THE INVENTION

It is an object to the present invention to provide a light emitting array apparatus that may be mounted directly to a supporting wall or support surface or may reduce the size, bulk or cost of such display devices. As a minimum, it is an object to the present invention to provide the public with a useful choice.

SUMMARY OF THE INVENTION

Accordingly, in the first aspect, the invention may broadly be said to consist in a light emitting array apparatus comprising:

- a support panel having a front face;
- a plurality of LEDs mounted on or adjacent said front face and in close thermal proximity to said support panel; and
- wherein heat from said plurality of LEDs is dispersed through said support panel and dissipated by said support panel to surrounding air from said front face of said panel around said LEDs.

Preferably said plurality of LEDs are arranged in an array comprising a plurality of substantially linear parallel rows of LEDs.

Preferably said support panel further includes a plurality of substantially linear parallel louvers positioned intermediate of said substantially linear parallel rows of LEDs.

Preferably said plurality of louvers form a plurality of channels in which said rows of LEDs are positioned.

Preferably an electrical circuit is provided intermediate of said support panel front face and said LEDs.

Preferably said electrical circuit is in the form of a PCB.

Preferably said electrical circuit is covered with weather proofing material.

Preferably said LEDs protrude through said weather proofing material covering said electrical circuitry.

Accordingly, in a second aspect, the invention may broadly be said to consist in a light emitting array apparatus comprising:

- a support panel having a front face;
- a plurality of louvers mounted substantially parallel on said front face to define channels therebetween;
- an array of a plurality of LEDs mounted within at least some of said channels close to said support panel; and
- at least one transverse channel in said support panel or louvers for the passage of power and/or data and/or control signal transmission means to said channels in which LEDs are mounted.

Accordingly, in a third aspect, the invention may broadly be said to consist in a light emitting array apparatus comprising:

- a support panel having a front face;
- a plurality of LEDs mounted on or adjacent said front face;
- mounting means for mounting said support panel to a support surface behind support panel; and
- heat dissipation means to distribute heat collected in said support panel to air surrounding the front face of said support panel.

Accordingly, in a fourth aspect, the invention may broadly be said to consist in a light emitting array apparatus comprising:

- a support panel containing at least one channel in a front face thereof;
- an electrical circuit provided on or in said channel;
- a plurality of LEDs mounted within said channel and connected to said electrical circuit; and
- weather proofing covering said electrical circuit within said channel.

Accordingly, in a yet further aspect, the invention may broadly be said to consist in a method of manufacturing a light emitting array apparatus comprising:

providing a support panel having a front face;

mounting electrical circuitry on said front face of said support panel;

mounting a plurality of LEDs to said front face of said support panel and connecting to said electrical circuitry; and providing weather proofing over said electrical circuitry to protect said electrical circuitry from moisture or water directed to a front face thereof.

BRIEF DESCRIPTION OF THE DRAWINGS

Preferred embodiments of the invention will now be described with reference to the following drawings in which.

DETAILED DESCRIPTION OF PREFERRED EMBODIMENTS

Figure 1:
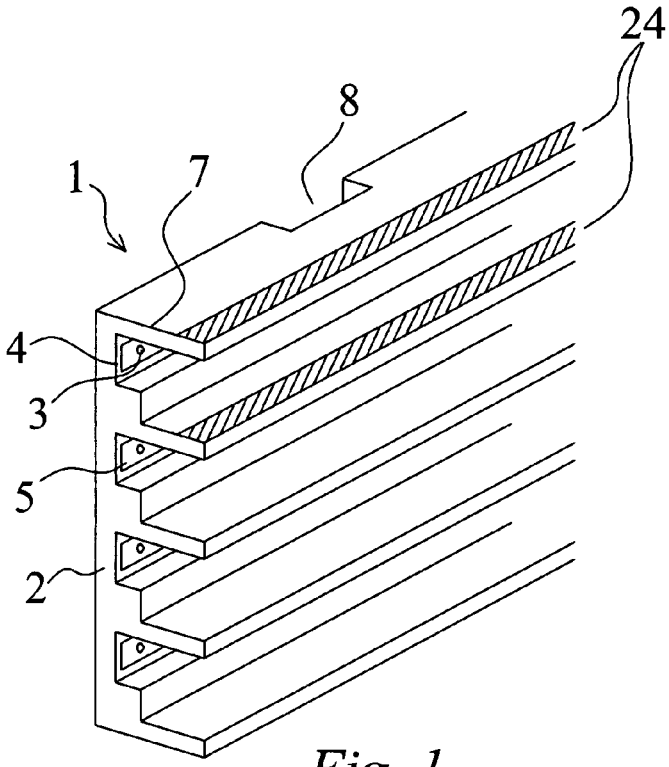
FIG. 1 shows a perspective view of a first embodiment of the invention.

This invention provides a light emitting array apparatus 1 such as a display device as may be shown in a first embodiment in FIG. 1. It should be noted from the outset that such a panel may be an entire device used in a lighting application or, more likely, a modular unit for use with a plurality of similar panels in the construction of a larger screen display or illuminating device. For this reason, the panel is not intended to describe an entire unit with all data, power or other items, except for those that may be used in a module itself. A variety of associated apparatus may be included in the construction of a large screen as is already well known in the art.

The display device 1 may include a support panel 2 onto which a plurality of light-emitting devices (LEDs) may be mounted. It is intended that the LEDs 3 may be forward facing and mounted to the front face 4 of the support 2.

The LEDs themselves require driving circuitry to supply a current signal appropriate for the light emission required from the diodes at any point in time. A shown in FIG. 1, an electrical circuit as may be provided on a printed circuit board 5 can also be mounted on the front face 4 of the support panel 2. It will be appreciated that printed circuit boards can be provided as thin, flexible tape-like circuits or as more rigid boards to which the LEDs may be mounted in the form of surface mounted LEDs or indeed connected through the circuit board to a circuit on the rear surface of the PCB 5.

It is intended that the present invention places the LEDs in close thermal proximity to the support panel 2 such that much of the heat generated by the LED can be distributed throughout the support panel 2 and dissipated to surrounding air passing the front face 4 of the support panel 2 around the LEDs 3. This reduces the need for complicated mechanisms behind the support panel 2 so as to distribute heat at the back or sides of the panels.

Figure 2:
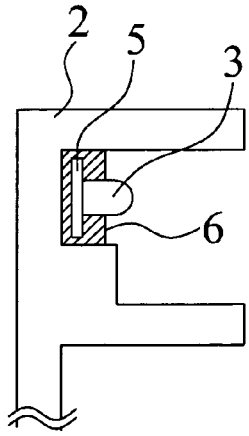
FIG. 2 shows a cross-sectional elevation through a portion of the apparatus of FIG. 1.
Figure 3:
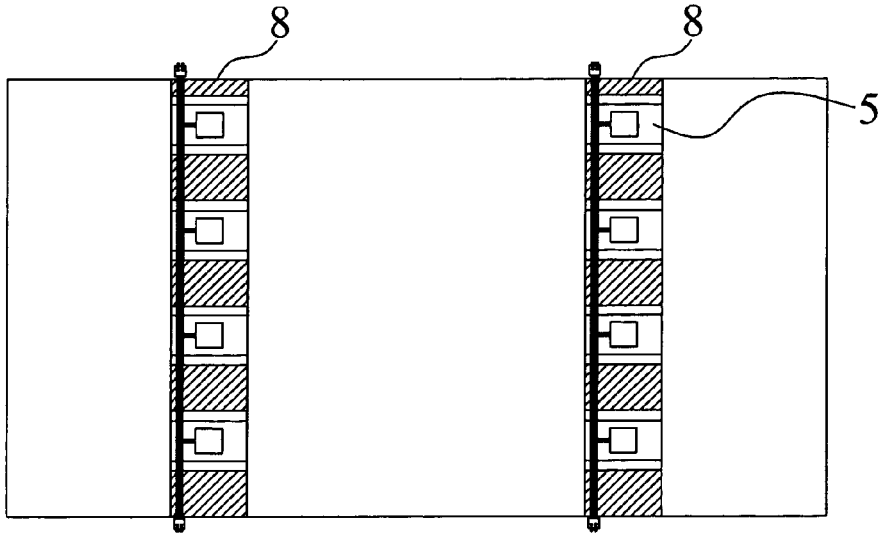
FIG. 3 shows a rear elevational view of the apparatus of FIG. 1.

With this in mind, the support panel 2 should be made from a relatively good thermally conductive material. Typically such materials would be in the form of metals or similar and hence both thermally and electrically conductive. On that basis, a construction may be provided as shown in FIG. 2 in which the PCB 5 may electrically isolate the LED 3 from the support panel 2 with the LED surface mounted onto the PCB 5. However, with the LED 3 still very close to the support panel 2, sufficient thermal conductivity may occur through the PCB 5 or through a common ground terminal so as to allow the support panel 2 to disperse the heat to surrounding air.

Also as shown in FIG. 2, such a display may require weatherproofing material 6 to be provided at least over the electrical circuitry provided on the PCB. In this particular embodiment, the LED 3 is shown as a lamp having a protruding lens and the weatherproofing material may be provided over the PCB 5 with the lens of the lamp 3 exposed through the weatherproofing material 6. Of course, it will be appreciated that some weatherproofing materials can be provided that minimize their optical effect on the LED 3 and hence could cover the LED 3 in such instances. In this particular embodiment, a silicon gel or similar weatherproofing material 6 may be provided over the PCB 5 to avoid the ingress of water, dirt, dust or similar.

Rather than use of a waterproofing gel or similar, it may be possible to mount a lens or substantially optically clear panel over the circuitry and LEDs within the channel. Lens that provide enhanced optical characteristics are known and may be provided as strips with a lens potion centred over each of the LED placements. This may not only provide waterproofing but greater light intensity, colour shift of lighting or other desired effects.

Also as shown in FIGS. 1 and 2, the support panel 2 may include a plurality of louvers 7 extending from the front face 4. These louvers provide shading so as to increase the contrast of the LEDs 3 against ambient light conditions whether that be sun load or artificial lighting. The louvers 7 may also provide an increased surface area for the dissipation of heat from the support panel 2 to the surrounding air. Further, such louvers may be used as a reflector to focus, reflect or direct the emitted light into a desired radiation pattern.

In this particular embodiment, the LEDs 3 may be arranged in a plurality of substantially parallel linear rows with at least one louver 7 arranged between each of the rows so as to provide a common contrasting effect and/or focusing effect over the entire display screen.

The louvers 7 may be mounted to the support panel by integral construction as shown in this embodiment or may be constructed as separate items thermally bonded or connected to the support panel to allow the transfer of heat to the louvers.

In use, the plurality of panels such as those shown in FIG. 1 may be arranged together to provide an entire display screen. It is necessary to provide current and/or data or control signals to the circuits on the PCBs and, to this end, a plurality of channels 8 may be provided in the rear face of the support panel 2 so as to expose the PCB 5 at regular intervals. Power cabling and data cabling can be run down these channels and connected to or through the PCB 5 to the electrical circuit to which the LEDs themselves are connected.

It will be appreciated that the channels 8 may not be necessary should power and data cabling be provided in a channel intermediate of adjacent panels. It may be possible to provide sufficient power and data signal to each of the rows of LEDs 3 through the end of the display screens or at the intermediate junctions between panels.

Figure 4:
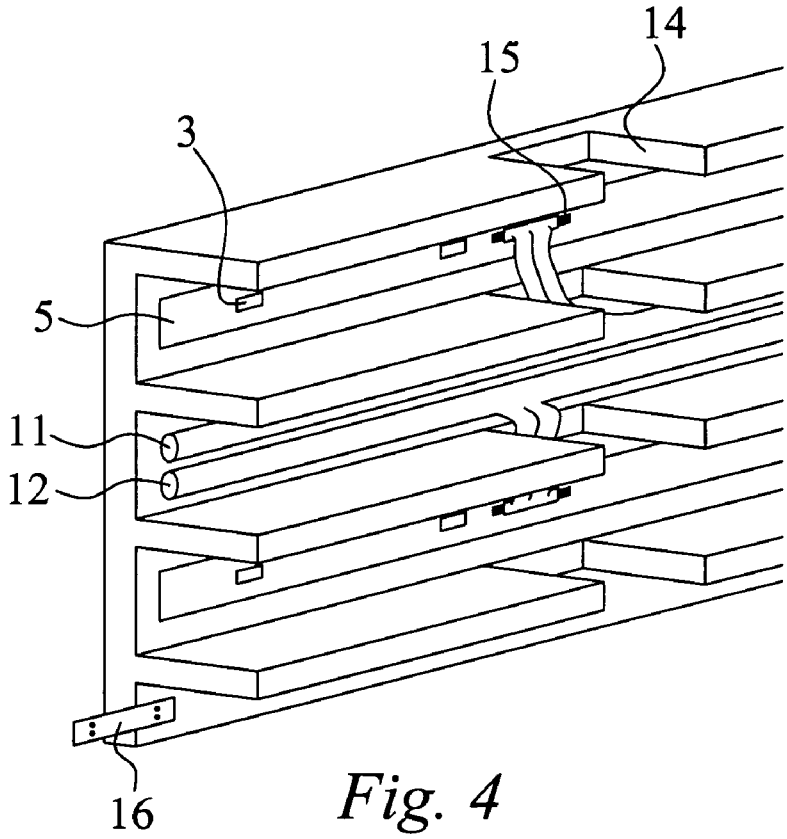
FIG. 4 shows a perspective view of a yet further embodiment of the invention.

An alternative arrangement for the panel is shown in FIG. 4 in which power and data cables 11 and 12 are provided in channels intermediate of those carrying the rows of LEDs 3. This allows the power and data cables to run along the front face 4 of the support panel 2 and channels 14 can be provided in the louvers 7 to allow cabling to be run from the power and data cable channel to the PCB 5 and to a driver 15 that may be typically provided on such a PCB. FIG. 4 also shows a connector 16 which may be provided on each of the sections of display panel for connection to adjacent display panels so as to construct an entire screen. It will be appreciated that the connector 16 could be of any desired form. Alternatively, a connector could be merely an aperture for direct securement of each of the support panels 2 against a wall or other backing structure.

Figure 5:
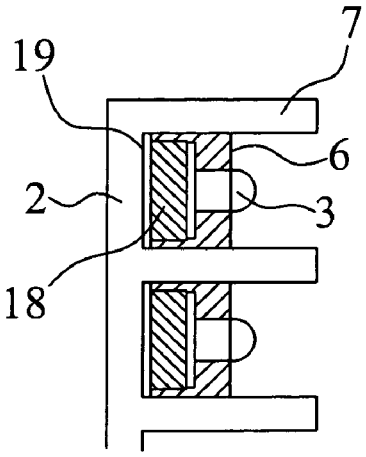
FIG. 5 shows a cross-sectional side elevation through a portion of an apparatus of a yet further embodiment of the invention.

A further embodiment of the invention is shown in cross-section in FIG. 5. In this embodiment, power may be supplied within the channels intermediate of the louvers 7 through the provision of a copper bus or similar 18. This may reduce the requirements for providing intermediate connection points for power cables with data cables perhaps fitting from the edge of each of the panels and remove the need for transverse channels 8 or 14 as shown in the previous embodiments. It will be appreciated that any such power bus 18 would need to be electrically isolated from the support panel 2 by some form of electrical insulator 19. However, it is desirable that good thermal conductivity still be provided from the LED 3 through to the support panel 2.

Figure 6:
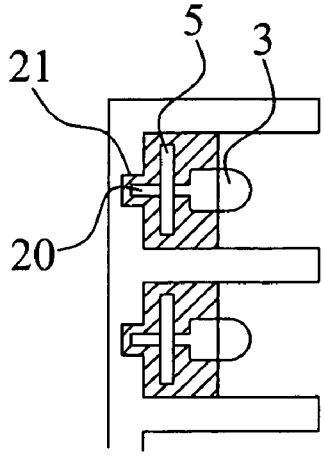
FIG. 6 shows a cross-sectional elevation through a portion of a yet further embodiment of the invention.

Referring to FIG. 6, an alternative structure is shown in which the LEDs 3 may be provided without surface mount capability and protrude through the PCB 5. The legs 20 of such an LED may be provided in a recess 21 within the support panel 2 or otherwise simply isolated from the support panel 2 electrically so as to avoid any short circuit through the LEDs.

In producing a display device as generally shown in FIG. 1, it can be appreciated that the support panel 2 may be made in a number of different ways. When made from a metallic material such as aluminium, this article may be cast, extruded or formed with additional channels such as transverse channels 8 in FIG. 1 being cut or otherwise provided in a structure.

To assist in the reduction of sun load for screens intended for outdoor use onto the display as a whole, at least the leading upper portion of the louvers 7 as shown by the portion 24 in FIG. 1 may be coated in a reflective material to try and reflect sunlight and decrease the absorption of heat from the sun by the panel itself. In contrast, alternative portions of the support panel 2 such as the underside of the louvers 7 may be coated in an alternative material so as to increase transfer of heat from the support panel 2 or portions of the louvers 7 to surrounding air circulating past the display panel 1.

If an embodiment is provided incorporating an electrical circuit in the form of a PCB 5, the PCB itself may be attached within the channels formed by the louvers 7 by a suitable adhesive. LEDs may then be surface mounted to the PCB 5 prior to placement of this weatherproofing material 6 such as a silicon gel or similar being poured or injected around the LEDs and over the electrical circuitry.

As an alternative of the use of a PCB, electrical circuitry may be provided directly onto the support panel 2. For example, should the support panel 2 be formed from aluminium, the aluminium may be coated or allowed to naturally form a layer of aluminium oxide. An anodizing process may be used to increase the thickness of this layer if necessary. The formation of an aluminium oxide layer within the channel in the region where the electric circuitry may be provided can act as an insulator to ensure that the electrical circuit is not short-circuited by the electrical conductivity of the support panel material itself.

An alternative to aluminium oxide layer may be a ceramic layer or such other insulator as may be desired.

Rather than constructing a PCB for fitment within the channel, electrical circuitry may then be deposited directly onto the insulated layer. Various known processes such as spluttering and/or etching the tracks onto the insulator may be used. For example, a metal such as titanium may be used for spluttering the tracks onto the insulator and then plated with a more suitable material for soldering as may be used in the surface mounting of the LEDs. Suitable plating material may be, for example, copper.

An alternative method of depositing the electrical circuitry onto the insulator would be to sinter a metal powder which may then be screen-printed or plot printed onto the insulator.

A yet further method may involve the use of metal powder mixed with epoxy that is cured onto the insulator although this may hinder the soldering of LEDs onto the electrical tracks because of the low temperature at which the epoxy may break down. Nevertheless, alternative connection methods for connecting the LEDs to the tracks are also available such as use of a conductive epoxy silver mix.

Figure 7:
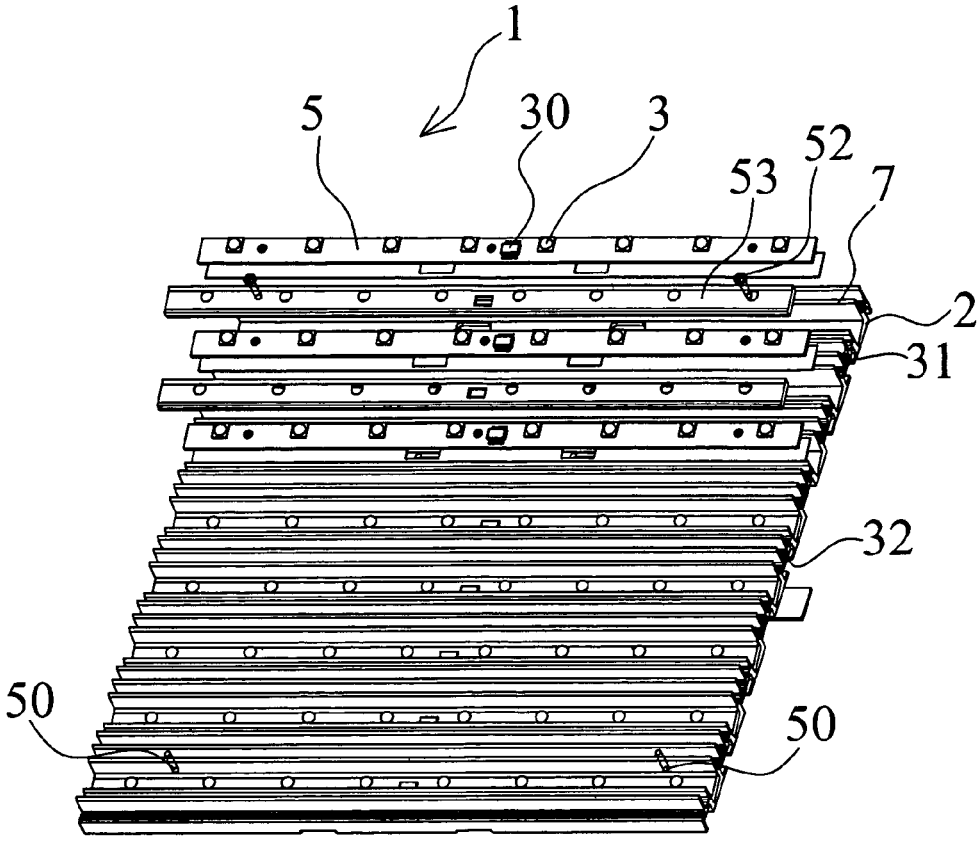
FIG. 7 shows a front perspective view of a yet further embodiment of the invention.

A yet further embodiment of the invention is shown as a display screen 1 in FIG. 7. It will be appreciated that many similarities between the embodiment in FIG. 7 and that shown in FIG. 1 exist with the embodiment as shown in FIG. 7 still providing a support panel 2 and a plurality of louvers 7, at least some of which may form a channel into which a PCB 5 carrying a plurality of LEDs 3 may be inserted. The embodiment as shown in FIG. 7 is shown with the PCB and LEDs inserted in the lower channels on the drawing although the three upper channels and PCB/LED assemblies are shown in exploded form for clarity. Additionally, suitable drivers 30 may be provided on each of the PCBs.

A covering lens or general weatherproofing cover 53 through which the LEDs may or may not protrude can be provided as an option. This may reduce the need for a gel or similar sealant, although such sealants may still be used around edges or openings to increase the weatherproofing.

Connectors 52 can be used to secure all of the items such as the PCB and/or optional cover 53 to the support panel. These connectors may be simple screws or bolts or other mechanical means or chemical adhesives. The connectors 52 may be used for permanent retention or may only serve a temporary purpose to secure items during curing of adhesives, sealants or other such materials.

It can be noted that in this embodiment, a plurality of intermediate louvers 31 are provided on the front face to again improve contrasting and also add as additional portions which may disburse heat to surrounding atmosphere on the front face of the panel.

A plurality of micro-louvers 32 may also be provided intermediate of the main louvers 7, 31. The micro-louvers 32 provide additional contrast enhancement for the LEDs.

Figure 8:
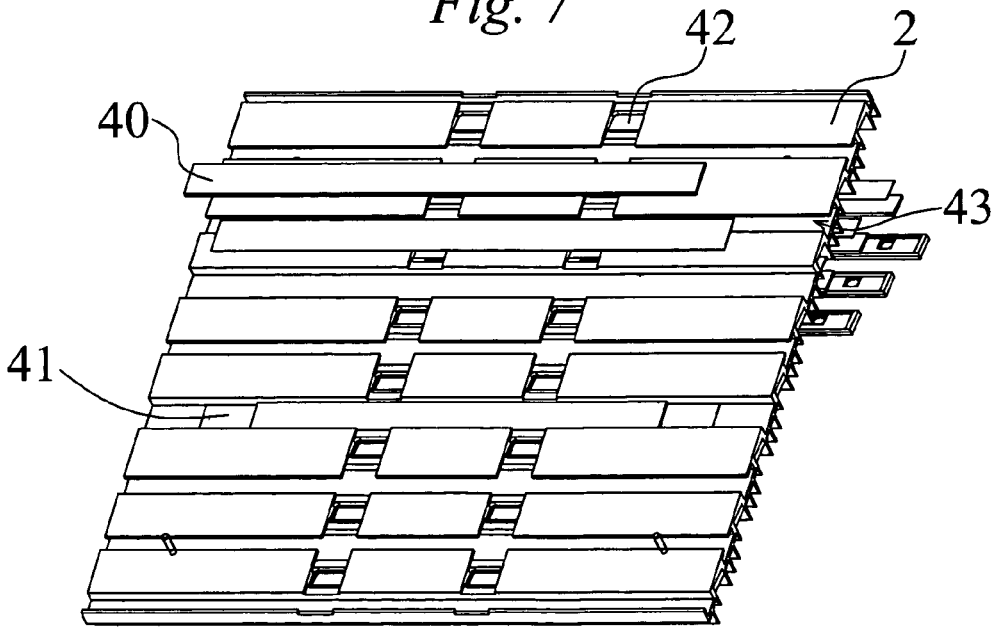
FIG. 8 shows a rear perspective view of the apparatus of FIG. 7.

Referring to FIG. 8, the rear surface of the support panel 2 is shown. It can be seen that the rear surface provides a plurality of channels 43 into which data PCBs 40 or power PCBs 41 may be arranged where desired. A plurality of apertures 42 through the support panel allow interconnection between the data and power PCBs and the PCBs carrying the LEDs in channels on the front face.

Referring to FIG. 2, it can be seen that the channels 43 that may carry data or power PCBs may be arranged and recessed into the support panel 2 intermediate of the channels 45 arranged in the opposed side of the support panel which carry the LEDs. This still allows the structure to be kept to minimum width while arranging recess channels for PCBs for the LEDs on the front face and recess channels for power and data PCBs on the rear face.

Also as can be seen in FIG. 7, apertures 50 may be arranged in suitable positions on the display panel 1 so as to allow direct fixing of the display panel 1 to a support structure behind the display panel. For example, such apertures act as connection means allowing the panel to be held against a wall or similar structure and simply screwed against the face of that wall to construct the support screen. Should the display screen be desired as a standalone item, framing or other supports may be arranged at suitable positions to allow connection through the support panel 2.

Figure 9:
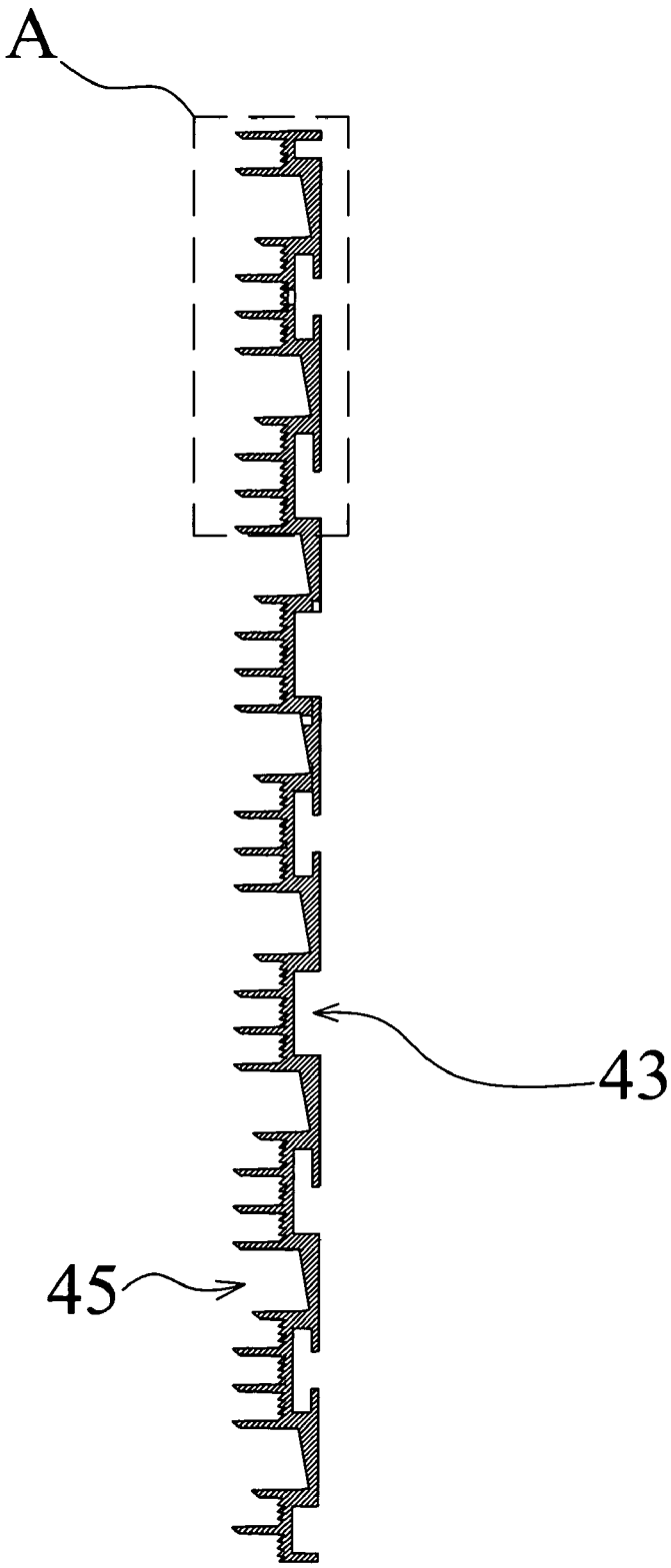
FIG. 9 shows a cross-sectional view through the apparatus of FIG. 7.
Figure 10:
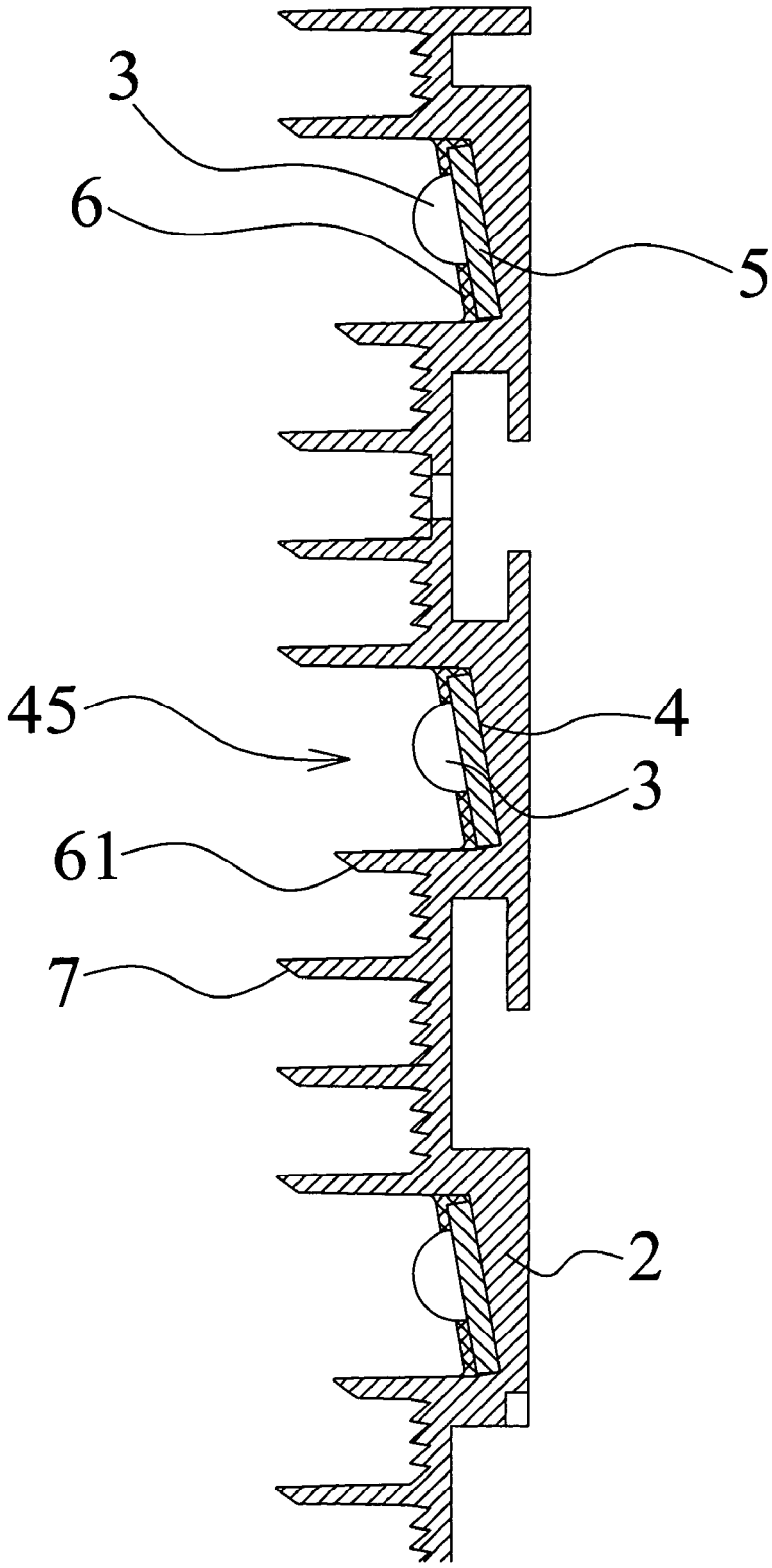
FIG. 10 shows a detailed cross-section through a portion of the apparatus of FIG. 8.

Referring to FIG. 10, a detailed portion 8 from FIG. 9 is shown in cross-section. It can be noted that the support panel 2 may be arranged such that the front face 4 on which the LEDs 3 may reside is at a slight incline to the vertical so as to direct the LEDs downwardly at an angle of, perhaps, 10 degrees. The use of an angle between 0 and 20 degrees may be desirable so as to allow better viewing of the LEDs should the display screen be used in an elevated position as this is often the case in the construction of billboards, sport stadium display screens or other such display screens.

It can also be noted that the louvers 7 may not be all of identical length. For example, the louver 61 adjacent a lower edge of a channel 45 in which the LED 3 resides may be slightly shorter to avoid the louver 61 obscuring the LED 3 when viewed from below and increase the overall viewing angle of the display screen.

Again, in this embodiment, the PCB may be inserted into the channels 45 and that air replaced by any suitable means such as adhesive or similar. Regardless, upon introduction and curing of a weatherproofing material such as a silicon gel 6, the PCB 5 will be inhibited from further movement and with little in a way of physical stress placed on such display screens, minimal attachment of the PCB 5 may be necessary or attachment may only be necessary as a temporary measure until the weatherproofing material has been inserted.

In the case of the use of such panels in the provision of panels for general illumination, the need for data cables may not prove necessary. Only the provision of a current might be sufficient for such uses to reduce the need for additional channels transverse to the louvers. This may particularly suit a construction using a copper bus under the PCB to which the LEDs are attached.

A sensor may also be mounted on or in the display panel 1. A sensor may be as simple as an illuminated LED that is in addition to the array and perhaps, if desired, working on a different frequency such as IR. Such an LED may be monitored to ensure an alarm is sounded should a panel lose power, thereby removing output from the additional LED.

Alternative sensors can include some form of image capture such as a CCD array to monitor performance and activation of a screen or panel. Various alternative means of monitoring may be included as desired for particular purposes. It will be appreciated that the level of monitoring desired may vary with the intended use of the device as general illumination or traffic signal panels may only require monitoring of activation and perhaps, general levels of illumination. This may also be monitored by control circuits measuring load drawn by the panels. In a panel used for video displays, more important monitoring to track usage, performance degradation and other characteristics of the screen may be preferred.

Thus it can be seen that the present invention provides a display screen in which a plurality of LEDs may be provided on a front surface of a support panel and enclose thermal proximity with that panel so as to allow the panel itself to draw and distribute the heat generated by the LEDs. This heat may then be dissipated largely through the front surface of the support panel 2 or from louvers 7 which may extend from that front face. This may minimize the need for complicated apparatus to draw heat from the rear of the support panel and exhaust such heat rearwardly. Furthermore, the removal of such apparatus may allow such panels to be directly attached to a wall or other support structure with little need for access to the rear of the panel.

Furthermore, such a display panel 1 is constructed of a relatively thin overall profile on the front surface to the rear surface to minimize the bulk of such display screens in use as well as in transit, storage or other such handling.

It will be appreciated that this description has described preferred embodiments of the invention which should not be considered limiting with the scope of the invention defined by the appended claims. Various integers referred to in the singular throughout the description or in the plural may be considered in the alternative where appropriate. Furthermore, integers described in the description may be deemed to incorporate known equivalents where possible.

The invention claimed is:

1. A light emitting array apparatus comprising:

a thermally conductive support panel having a front face; and a plurality of LEDs mounted on or adjacent said front face and in close thermal proximity to said support panel;

wherein heat from said plurality of LEDs is dispersed through said support panel and dissipated by said support panel to surrounding air from said front face of said panel around said LEDs;

wherein said support panel further includes a plurality of substantially linear parallel louvers positioned intermediate of said plurality of LEDs, said louvers being arranged to provide shading for said LEDs to increase contrast of the LEDs against ambient light conditions; and wherein a plurality of micro-louvers are disposed intermediate said louvers, said micro-louvers being disposed for additional contrast enhancement for said LEDs.

2. The light emitting array apparatus as claimed in claim 1, wherein said plurality of LEDs are arranged in an array comprising a plurality of substantially linear parallel rows of LEDs.

3. The light emitting array apparatus as claimed in claim 1, wherein said louvers are further configured to focus, reflect or direct light emitted by said LEDs into a predetermined pattern.

4. The light emitting array apparatus as claimed in claim 3, wherein said plurality of louvers form a plurality of channels in which said rows of LEDs are positioned.

5. The light emitting array apparatus as claimed in claim 1, wherein an electrical circuit is provided intermediate of said support panel front face and said LEDs, said electrical circuit being deposited on said panel front surface.

6. The light emitting array apparatus as claimed in claim 1, wherein an electrical circuit is provided intermediate of said support panel front face and said LEDs, said electrical circuit is in the form of a PCB.

7. The light emitting array apparatus as claimed in claim 5, wherein said electrical circuit is covered with weather proofing material.

8. The light emitting array apparatus as claimed in claim 7, wherein said LEDs protrude through said weather proofing material covering said electrical circuitry.

9. The light emitting array apparatus according to claim 1, wherein said front face is inclined with respect to said support panel and said LEDs are directed at an inclination with respect to said louvers.

10. The light emitting array apparatus according to claim 9, wherein said inclination is at between 0 and 20 degrees with respect to the support panel.

11. The light emitting array apparatus according to claim 1, wherein said louvers are of non-identical length whereby the overall viewing angle of said apparatus is increased.

12. The light emitting array apparatus according to claim 11, wherein a louver immediately downwards of an LED is of a smaller height than other louvers.

13. The light emitting array apparatus according to claim 10, wherein said inclination is at 10 degree with respect to the support panel.

* * * * *